US005777547A

United States Patent [19]

Waldrop

[11] Patent Number: 5,777,547

[45] Date of Patent: Jul. 7, 1998

[54] CAR IDENTIFICATION AND ORDERING SYSTEM

[75] Inventor: Jeremy S. Waldrop, Aurora, Ill.

[73] Assignee: Zeftron, Inc., Montgomery, Ill.

[21] Appl. No.: 744,086

[22] Filed: Nov. 5, 1996

[51] Int. Cl.[6] ..... B60Q 1/00; G08B 1/08; B61L 3/00

[52] U.S. Cl. ..... 340/438; 340/536; 340/538; 340/825.34; 246/167 R

[58] Field of Search ..... 340/933, 903, 340/435, 438, 538, 536, 825.34, 825.51; 246/6, 28 R, 167 R, 182 B, 187 C; 303/3, 15; 180/167 R

[56] References Cited

U.S. PATENT DOCUMENTS

| | | | |
|---|---|---|---|
| 3,696,758 | 10/1972 | Godinez, Jr. | 246/167 R |
| 4,041,283 | 8/1977 | Mosier | 246/167 R |
| 4,344,364 | 8/1982 | Nickles et al. | 246/167 R |
| 4,532,511 | 7/1985 | Lemelson | 340/933 |
| 4,553,723 | 11/1985 | Nichols et al. | 246/167 R |
| 4,582,280 | 4/1986 | Nichols et al. | 246/167 R |
| 4,682,144 | 7/1987 | Achiai et al. | 246/167 R |
| 4,689,602 | 8/1987 | Morihara et al. | 340/438 |
| 5,039,038 | 8/1991 | Nichols et al. | 246/167 R |
| 5,131,038 | 7/1992 | Puhl et al. | 340/825.34 |
| 5,182,466 | 1/1993 | Ohkubo | 307/127 |
| 5,377,938 | 1/1995 | Bezos et al. | 246/167 R |
| 5,383,717 | 1/1995 | Fernandez et al. | 246/167 R |
| 5,530,328 | 6/1996 | Fernadaze et al. | 246/187 C |

*Primary Examiner*—Brent A. Swarthout
*Assistant Examiner*—Van T. Trieu
*Attorney, Agent, or Firm*—Lloyd L. Zickert

[57] ABSTRACT

A car identification and ordering system for trains which identifies each car in the train, the order of those cars, the total number of cars in the train, and the identification of the last car in the train. The car identification and ordering system may work in conjunction with an electronic pneumatic brake system on a train or can work independently of an electronic pneumatic brake system.

19 Claims, 4 Drawing Sheets

CAR ORDERING SYSTEM

MASTER CONTROLLER CAR ORDERING PROCESS

CAR IDENTIFICATION AND ORDERING SYSTEM

DESCRIPTION

This invention relates in general to a car identification and ordering system for trains, and more particularly to a railroad car identification and ordering system which identifies each car in the train, the order of the cars, the total number of cars, and the identification of the last car in the train.

BACKGROUND OF THE INVENTION

Electronically controlled pneumatic brake systems for railroad trains currently are being developed to replace the pneumatic brake systems (or air brakes) which have long been in use on railroad trains in North America, Europe, and substantial parts of the world. In electronically controlled pneumatic brake systems, control of braking applications throughout the train and specifically on each car is accomplished through a computer controlled network wherein each car is equipped with a control device or controller and the locomotive is equipped with a head end unit or master controller which communicates with the control devices to control braking throughout the train.

To operate these advanced electronic pneumatic brake systems, especially on long freight trains, such as one having one hundred fifty cars, it is generally necessary for the head end unit to have information on the make-up of the train including the identification of each car in the train, the order of those cars, the total number of cars, and the specific identification of the last car in the train. This information could be manually entered into the head end unit during train set-up; however, due to the number of cars, manual entry would be extremely time-consuming, labor-intensive, and subject to errors.

The train make-up information could also be electronically entered into the head end unit during train set-up from a disc containing the information or through telecommunications with another computer.

Alternatively and preferably, the head end unit could be programmed to electronically obtain and/or verify this information independently after the train is set up as well as during driving of the train. For instance, during driving of the train, it is important for the engineer to be able to verify that all of the cars in the train are still attached to the train and are responding, individually, to electronic commands from the head end unit. Accordingly, there is a need for a quick and efficient car identification and ordering system for identifying each car in the train, the order of those cars, the total number of cars, and the specific identification of the last car in the train at any time during operation of the train.

SUMMARY OF THE INVENTION

The present invention provides a car identification and ordering system for trains which determines the identity of each car in the train, the order of those cars, the total number of cars, and the specific identification of the last car in the train. The car identification and ordering system is adapted to work in conjunction with an electronic pneumatic brake system on a train, although it should be appreciated that the car ordering system could work independently of an electronic pneumatic braking system.

The car identification and ordering system of the present invention includes an electronic head end unit ("HEU") or master controller on the locomotive for controlling the system, for sending signals to and receiving signals from the cars, for storing information on the number, identification, and order of the cars, and for displaying this information to the engineer. The master controller is connected via hardwire or wireless communication means to the first car and each successive car in the train. The car identification and ordering system further includes a car control device or car controller mounted on each car of the train for sending signals to and receiving signals from the master controller, for storing information about that car, and for controlling communication with the other cars in the train. Each car includes at least one repeater, controlled by the car control device, which facilitates and enables communication or the transfer of the signals received from the locomotive or the preceding car to the trailing or successive car. The repeater is also adapted to temporarily suspend or disable communication or the transfer of the signals to the trailing or successive car in the train.

During train setup, the head end unit and the car controllers throughout the train are turned on. When the car controller is turned on, it controls the repeater on that car which facilitates communication between the cars. After a train is set up, the car identification and ordering system of the present invention is initiated by the master controller or HEU on the locomotive which sends a "go to ordering mode" message to the first car in the train. Upon receipt of the "go to ordering mode" message, the first car transfers this message to the next or trailing car, which in turn further transfers the message to the successive cars in the train one by one. The "go to ordering mode" message is thus transmitted to each car in the train. After this message is transferred, the car controller of each car temporarily disables the repeater on that car, thereby preventing the communication or transfer of any subsequent signals received by the car from the master controller to the successive car. The car controller then awaits further instructions from the master controller for a period of time. Accordingly, every repeater on every car, including the first car and the last car, is temporarily disabled after the car receives and transfers the "go to ordering mode" message.

The master controller then sends an "identification request" signal to the first car. Only the first car receives this signal because the repeater on the first car is temporarily disabled, and therefore the message is not transferred to the second car or any of the successive cars in the train. The car controller on the first car responds to this signal by sending an "identification" signal back to the master controller which provides the master controller with information regarding the first car. The master controller stores this car identification information into the first car position in its database or list. The car controller on the first car, after sending the "identification" signal, indicates to itself that for this specific ordering mode or sequence, it has given its identification to the master controller and it will ignore subsequent "identification" signals by the master controller. Further, the car controller turns on or re-enables the repeater on the first car to re-establish communication between the first car and the second car.

The master controller then sends a second "identification request" signal to the first car. When the car controller on the first car receives this signal, it will not send an "identification" signal to the master controller because it knows it has already responded to such a request in this ordering sequence. The repeater on the first car, which is now operating or re-enabled, facilitates the transfer of this "identification request" signal to the second car on the train. The temporarily disabled repeater on the second car will not allow the second car to transfer this signal to the third car.

The controller on the second car responds to this "identification request" signal by sending its "identification" signal back through the first car to the master controller. The master controller stores this car identification information in the second car position in its database or list. After sending the "identification" signal, the controller on the second car indicates to itself that for this ordering sequence, it has given its identification and it will not send further "identification" signals to the master controller in this sequence and will thereafter ignore further identification requests from the master controller. Further, the car controller will also turn on or re-enable the repeater on the second car to reestablish communication between the second and third cars.

This process is repeated until the car controller in the last car in the train turns on or re-enables its repeater and sends its "identification" signal to the master controller. When the master controller sends out another "identification request" signal, it will not receive any further "identification" signals within a predetermined period of time and will then know that there are no more cars in the train and that the last "identification" signal it received was from the last car in the train. It will also know exactly how many cars are in the train and will have the order of the cars in its database or list. The master controller can electrically compare the number of cars to imputed data on the number of cars in the train to verify this information, or display the number of cars for verification by the engineer.

It is therefore an object of the present invention to provide a railroad car identification and ordering system which identifies each car in the train, the order of those cars, the number of cars, and the identification of the last car in the train.

A further object of the present invention is to provide a railroad car identification and ordering system which identifies each car in the train, the order of those cars, the number of cars, and the identification of the last car in the train which works in conjunction with an electronic pneumatic brake system.

A yet further object of the present invention is to provide a railroad car identification and ordering system which identifies each car in the train, the order of those cars, the number of cars, and the identification of the last car in the train which works independently of an electronic pneumatic brake system.

A still further object of the present invention is to provide a railroad car identification and ordering system having a master controller on the locomotive and a car controller on each car which communicate through hard-wire communications.

A further object of the present invention is to provide a railroad car identification and ordering system having a master controller on the locomotive and a car controller on each car which communicate through wireless communications.

Other objects, features and advantages of the invention will be apparent from the following detailed disclosure, taken in conjunction with the accompanying sheets of drawings, wherein like reference numerals refer to like parts.

DESCRIPTION OF THE INVENTION

Figure 1:
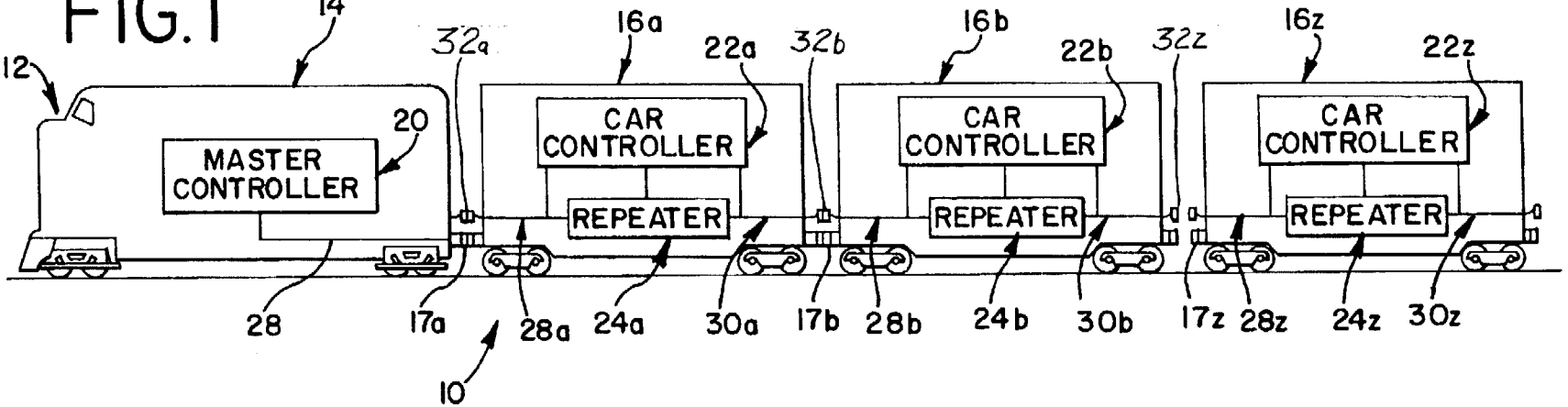
FIG. 1 is a fragmentary schematic view of a train equipped with the car identification and ordering system of the present invention and illustrating the master controller or head end unit ("HEU") on the locomotive, a car controller on each car, a repeater on each car, and hardwired communications between the cars.

Referring now to the drawings, and particularly to FIG. 1, the car ordering system of the present invention, generally indicated by numeral 10, is mounted on a train 12 having a locomotive 14 and a plurality of cars 16*a*, 16*b*, . . . and 16*z* suitably attached to the locomotive and each other by couplings 17*a*, 17*b*, . . . and 17*z*. Car 16*a* represents the first car in the train and car 16*z* represents the last car in the train, although the number of cars in the train could vary. The car ordering system 10 generally includes a master controller or electronic head end unit 20 mounted in the locomotive 14, car control devices or car controllers 22*a*, 22*b*, . . . and 22*z* mounted on the cars 16*a*, 16*b*, . . . and 16*z*, and repeaters 24*a*, 24*b*, . . . and 24*z*, respectively, mounted on each car.

Figure 3:
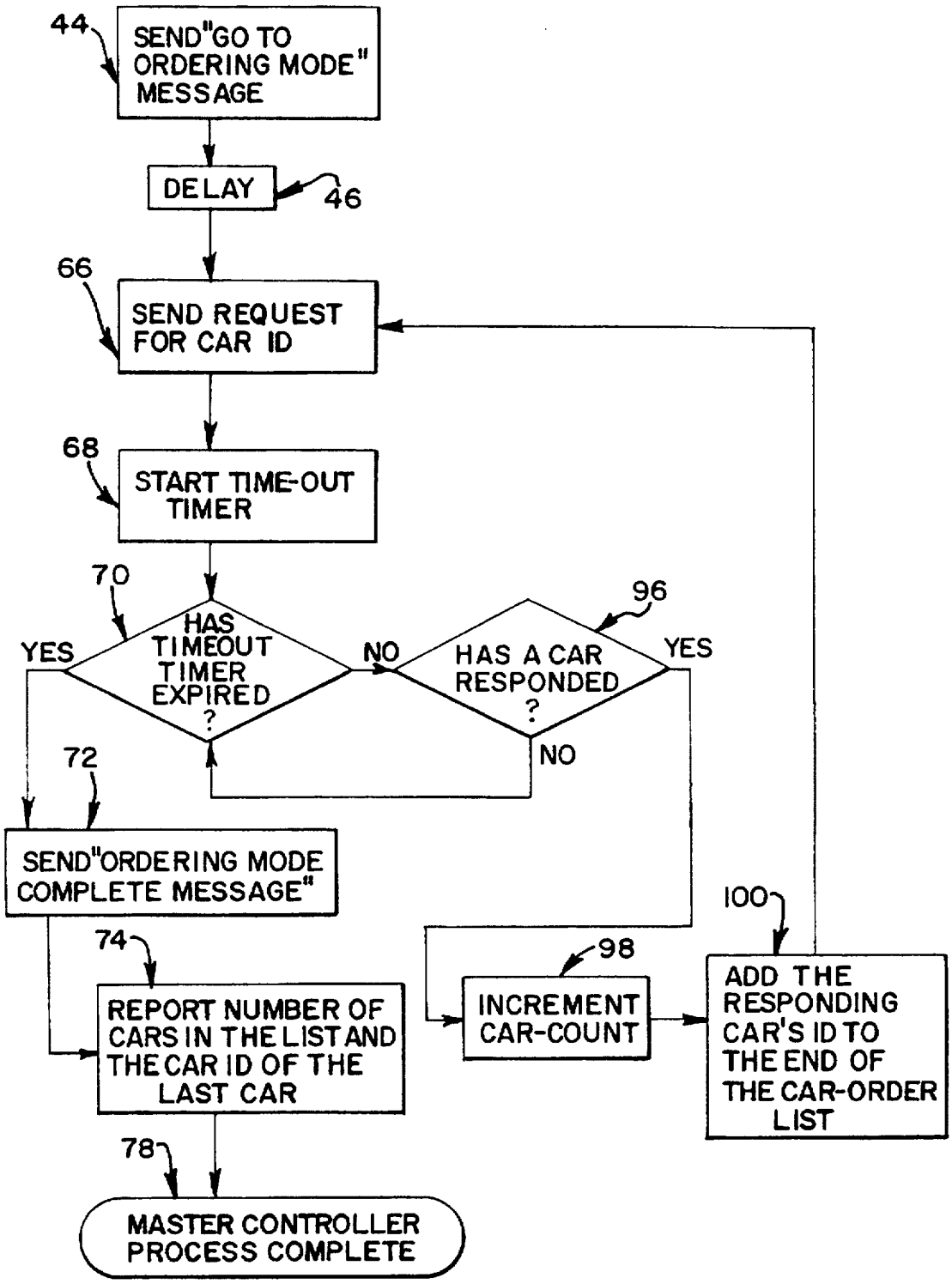
FIG. 3 is a flow chart illustrating the operation of the HEU or master controller of the present invention.

More particularly, the master controller or head end unit 20 is preferably mounted in the locomotive control panel for access by the engineer. The master controller includes a suitable microprocessor for controlling the car identification and ordering system, for sending and receiving signals to and from the cars, for storing information about the cars, for receiving information and commands from the engineer, and for displaying information to the engineer. The master controller's microprocessor is preferably the same microprocessor as the HEU in the electronic pneumatic brake system or could alternatively be a separate microprocessor. The master controller's microprocessor is programmed to conduct a car identification and ordering sequence or process, as illustrated in the flowchart of FIG. 3, and as discussed below. The master controller is suitably powered by a source of electrical power in the locomotive used to drive accessories.

The car controllers or car control devices 22*a*, 22*b*, . . . and 22*z* are preferably mounted in a suitable location on the cars adjacent to the brake system control valve. Each car controller includes a suitable microprocessor for receiving and storing information about the car, for monitoring signals from adjacent cars, and for controlling communication between the cars by enabling and disabling the repeaters. This microprocessor is preferably the same microprocessor as the controllers on the cars in the electronic pneumatic brake system or could be a separate microprocessor. The car controller's microprocessor is programmed to respond to car ordering and identification signals or commands from the master controller, as further illustrated in the flowchart of FIG. 4, and as described below. The car controller is powered by a suitable electrical power source on the car, such as a rechargeable battery.

In one embodiment of the present invention, to establish communications between the master controller 20 and the car controllers 22*a*, 22*b*, . . . and 22*z*, the cars 16*a*, 16*b*, . . . and 16*z* are hardwired to the locomotive 14 and to each other by twisted-pair cables running the length of the train and including cable 28 on the locomotive 14, cables 28*a* and 30*a* on car 16*a*, cables 28*b* and 30*b* on car 16*b*, . . . and cables 28*z* and 30*z* on car 16*z*, as illustrated in FIG. 1. The twisted-pair cables are connected between cars by conventional connectors 32*a* between the locomotive 14 and car 16*a*, 32*b* between cars 16*a* and 16*b*, . . . and 32*z* to the last car 16*z*, respectively. Communication via twisted-pair cable can occur at very high data rates. To achieve these high data rates over long distances, the data signal must be suitably amplified at fixed intervals along the cable. This amplification may occur in the repeaters 24*a*, 24*b*, . . . and 24*z* or along any one of the cables 28*a* or 30*a*, 28*b* or 30*b*, . . . and 28*z* or 30*z*. The repeaters, which may be mounted in the car controllers or in any suitable location on the car, facilitate transfer of these amplified data signals to the adjacent cars. The repeater is positioned to allow the car to be set up in the train in either direction and to allow a message to be sent from car to car toward the rear of the train or toward the front of the train. The repeaters 24*a*, 24*b*, . . . and 24*z* are connected to and controlled by the car controllers 22*a*, 22*b*, . . . and 22*z*.

The car controller can electrically disable the repeater or signal the repeater to electronically disable itself to prevent the repeater from transferring the signal from the master controller to the adjacent cars such as the trailing or successive car. The repeater may accomplish this in any suitable manner, such as by disabling the connection between the cables 28*a* and 30*a*. Once a repeater is disabled, electronic communication with all of the successive cars in the train is cut. Since this break in communication is undesirable for any significant length of time, the car controller and/or the repeater preferably include one or more fail-safe systems for re-enabling the repeater after a period of time. For instance, the repeater may include a built-in timer which is activated when the repeater is disabled. The timer re-enables the repeater if no signal is received from the car controller within a predetermined "time-out" period. Likewise, the car controller may include a timer which tells the controller to send a message to re-enable the repeater if no signal is received from the master controller within a predetermined "time-out" period. Additionally, if power to the car controller or repeater is temporarily disrupted during a car-ordering sequence, the car controller and or the repeater can be initialized with its communications enabled. It should be appreciated that other suitable fail-safe systems could be employed in the car ordering system of the present invention, such as back-up batteries for the master controller, car controllers, and repeaters. The car controller and the repeater coact to facilitate control over the transfer of the signal along the twisted cables in the train.

Figure 2:
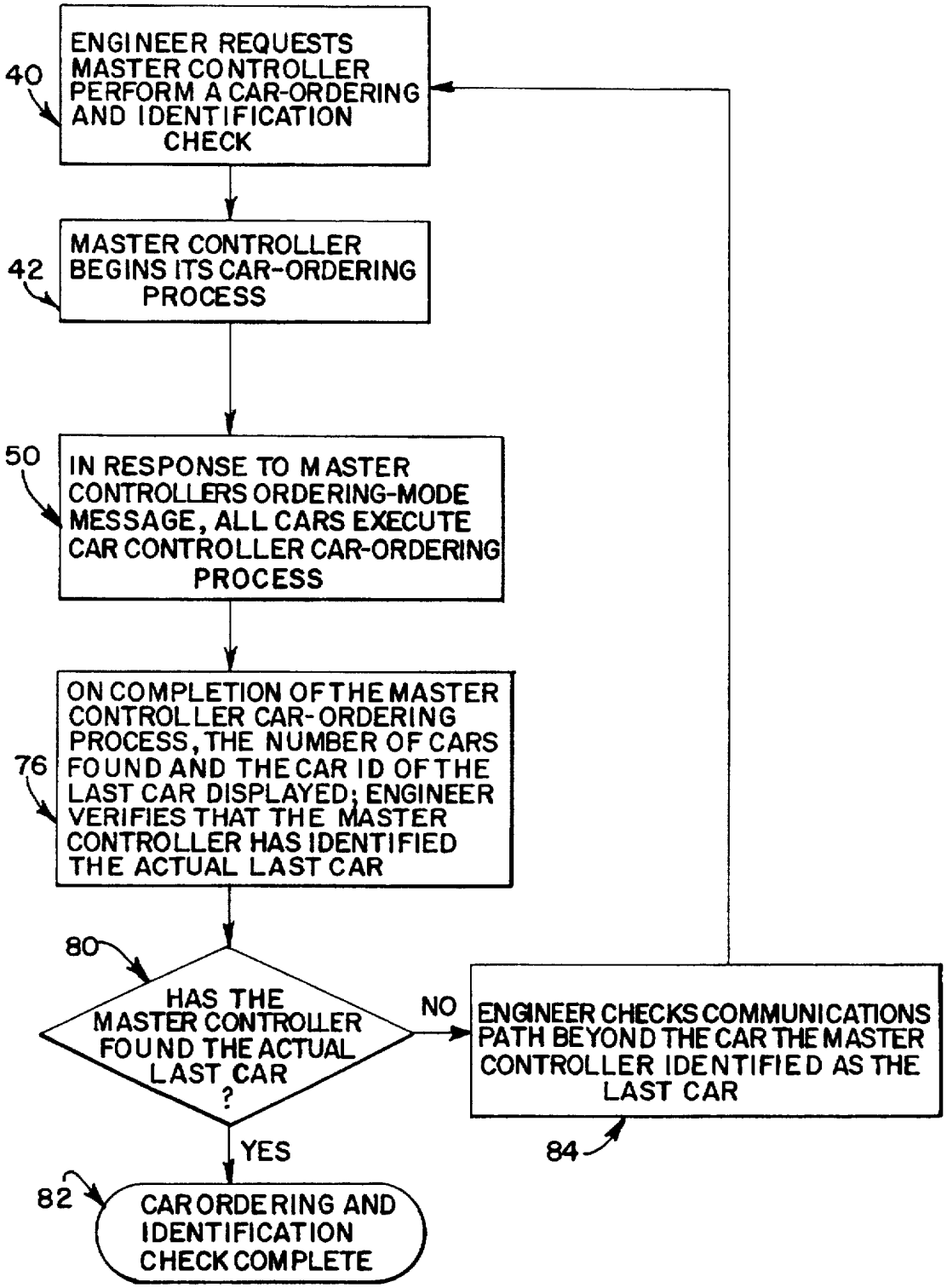
FIG. 2 is a flow chart illustrating the operation of the overall car identification and ordering system of the present invention.
Figure 4:
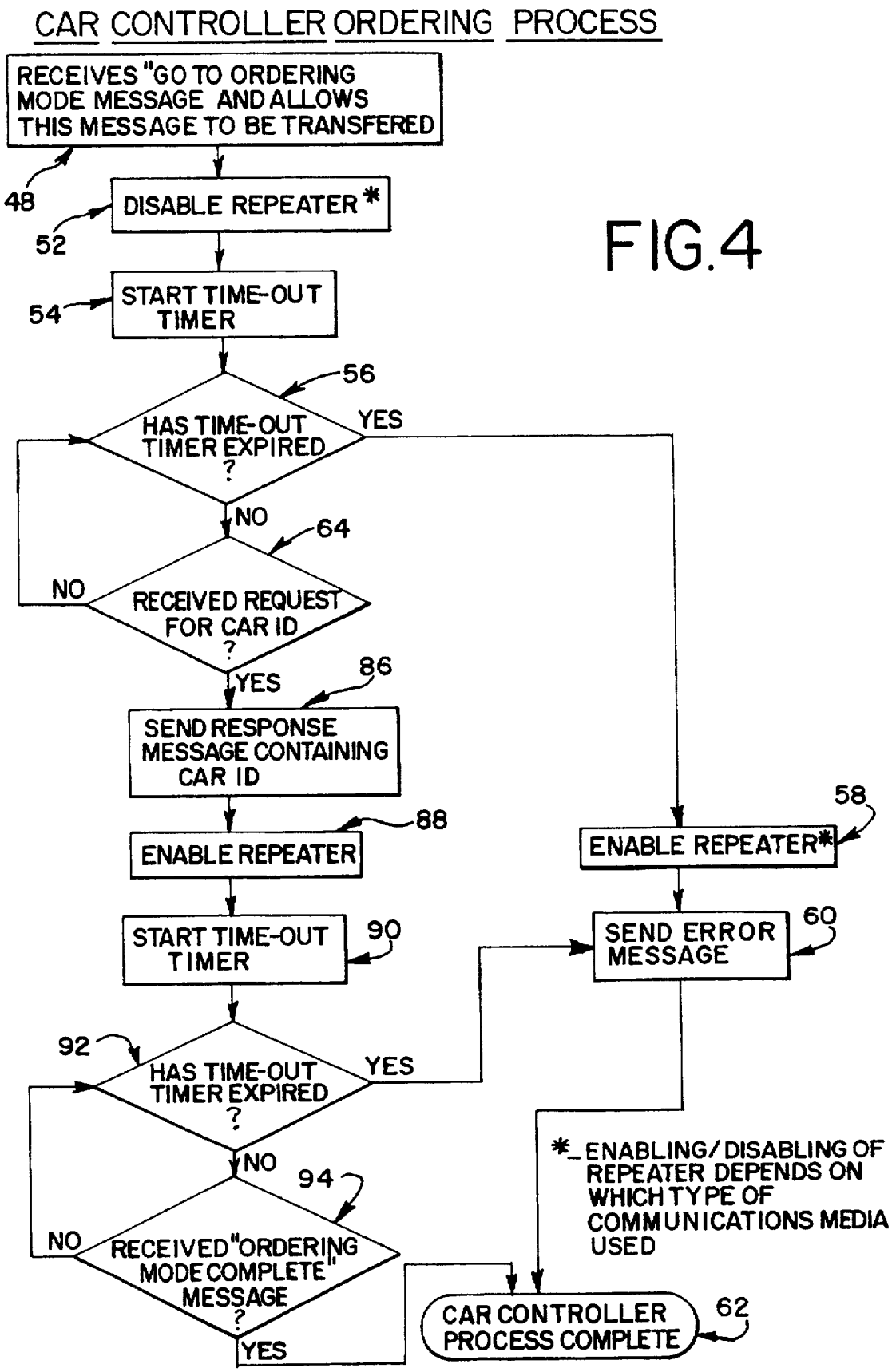
FIG. 4 is a flow chart illustrating the operation of a car controller of the present invention.

Referring now also to FIGS. 2 to 4, the master controller or the head end unit (HEU) and the car controllers are programmed to facilitate the car identification and ordering process to identify each car in the train, the order of those cars, the total number of cars, and the identification of the last car in the train. After the train 12 is set up, the engineer initiates the car identification and ordering process or check, as shown in block 40 of FIG. 2, by giving the master controller 20 the appropriate request or command, which may include pressing a button or entering a single or a series of commands on the control panel for the master controller. Upon receipt of an ordering request or command, the master controller 20 begins the execution of the car ordering and identification process, as shown in block 42, by sending a "go to ordering mode" message, as further shown in block 44 of FIG. 3, along the twisted-pair cable 28, through connector 32*a*, to cable 28*a* on the first car 16*a* of the train 12. The master controller then enters a delay period as demonstrated by block 46 to allow sufficient time for all of the car controllers to receive the "go to ordering mode" message and to temporarily disable their respective repeaters.

This "go to ordering mode" signal is received by the car controller 22*a* on the first car which monitors transmissions on cable 28*a*, as shown in block 48 and upon receipt of this signal, the car controller 22*a* enters the car ordering mode, as shown in block 50. This signal, which is amplified at repeater 24*a* or along cables 28*a* or 30*a*, is transferred along cable 30*a* to the trailing car 16*b*. The trailing car 16*b* in turn further amplifies and transfers this signal to successive cars in the train in the same fashion, as also indicated by block 48. The "go to ordering mode" message is thus transmitted to each car in the train, and after the message is transmitted, the car controllers begin the execution of the car ordering process by shutting down or temporarily disabling the repeaters 24*a*, 24*b*, . . . and 24*z*, as shown in block 52. Accordingly, the repeaters which facilitate communication to the trailing cars are temporarily shut down after the "go to ordering mode" message. Each car controller also starts a timer which may be in the car controller or the repeater, as shown in block 54, and awaits further signals for a predetermined period of time, as illustrated by diamond 56. If the time-out period expires before an "identification request" signal is received by the car controller, the car controller will re-enable the repeater, as shown in block 58, send an error message to the master controller, as shown in block 60, and exit the car controller process, as shown in oval 62. If the time-out period has not expired, the car controller continues to wait for an "identification request" signal from the master controller, as shown in the looped diamonds 56 and 64.

Within the predetermined period of time, the master controller 20 sends an "identification request" signal, as shown in block 66, to the first car 16*a* via cable 28 and 28*a*, and starts a timer on the master controller, as shown in block 68. If an "identification" signal from a car is not received by the master controller within a predetermined period of time, as illustrated by diamond 70, the master controller will send an "ordering mode complete" signal to the cars, as shown in block 72, will report or display the number of cars in its list and the identification of the last car to the engineer, as shown in blocks 74 and 76, and will exit the ordering mode or sequence, as shown in oval 78. If the master controller has found the last car, as illustrated by diamond 80, the car ordering and identification check is complete, as indicated by oval 82. If the engineer determines that the master controller has not identified the last car in the train, the engineer must check the communications path beyond the car identified by the master controller as the last car in the train, as shown in block 84, and thereafter restart the car identification and ordering process. If the time-out period has not expired, the master controller continues to wait for an "identification" signal from a car, as shown in looped diamonds 70 and 96.

The "identification request" signal from the master controller will only be received by the first car, as shown in diamond 64, because the repeater 24*b* on the first car 16*a* is disabled, and therefore the "identification request" signal is not transferred (i.e., or repeated) to the second or any successive cars in the train. The car controller 22*a* on the first car responds to this signal by sending an "identification" signal containing relevant information about the car, as shown in block 86 through cables 28*a* and 28 and back to the master 20 controller. The car controller 22*a* on the first car 16a, after sending its "identification" signal to the master controller, indicates to itself that for this ordering mode or sequence, it has given its identification and it will not respond to subsequent "identification request" signals. Further, the controller turns on or enables the repeater 30a, as shown in block 88, in the first car so that subsequent identification request messages from the master controller will be communicated to the second car. The car controller will also start its timer, as shown in block 90, and await an "ordering mode complete" message, as shown in looped diamonds 92 and 94. If the car controller receives the "ordering mode complete" message within the period of time, the car control process is complete, as shown in block 62. If this message is not received, the car controller will send an error message, as shown in block 60, and will exit the car controller ordering process, as shown in oval 62.

The master controller 20, which is awaiting a response from a car, as shown in diamond 96, receives this "identification signal" and increments the car count (which starts at zero), as shown in block 98. The master controller places the car's identification information at the end of its car order list, as shown in block 100, which in this case is the first car position. The master controller 20 now knows the identification of the first car, the order of the cars, the (temporary) total number of cars, and the (temporary) identification of the last car in the train.

Since the master controller received an "identification" signal from a car, it will send out a further "identification request" signal to the cars, as shown in block 66. This signal is sent along cable 28 to cable 28a which is monitored by car controller 22a. When the car controller 22a on the first car receives this signal, it will not send an "identification" signal to respond to the master controller because it knows it has already responded to such a request in this ordering sequence. The "identification request" signal will also be transferred through repeater 24a, which is now enabled or operating, to cable 30a and to cable 28b on the second car 16b of the train. The car controller 22b, which monitors cable 28b, will receive this "identification request" signal; however, the disabled repeater 24b on the second car 16b will not allow transfer of this signal to the third car. The car controller 22b on the second car 16b responds to this "identification request" signal by turning on or enabling its repeater 24b and sending its "identification" signal back to the master controller 20. More particularly, the car controller 22b will send its "identification" signal along cable 28b to cable 30a on the first car 16a. This signal is received by car controller 22a, which monitors cable 30a, but which takes no action based on this signal. The "identification" signal is amplified at the repeater 24a or along cable 30a or cable 28a prior to being transferred to cable 28 on the locomotive and thus to the master controller.

When this "identification" signal is received, the master controller 20 increments its counter and places this car identification information into the second car position in its database or list and makes this second car the temporary last car in the train. After sending the "identification" signal, the car controller 22b on the second car 16b indicates to itself that for this ordering sequence, it has given its identification and it will not respond to subsequent "identification request" signals. Further, it will turn on repeater 24b so that communication is possible to the next trailing car.

This process is repeated until the car controller 22z in the last car 16z in the train turns on or enables its repeater 24z and sends its "identification" signal to the master controller 20 through the rest of the cars in the train. When the master controller sends out another "identification request" signal, it will not receive any further "identification" signals within the predetermined time period because all of the cars in the train have already sent their "identification" signals to the master controller. The master controller will then send an "ordering mode complete" signal to the car controller, as shown in block 72. Upon receipt of this message, the ordering mode on each car controller will be complete, as shown in diamond 94 and oval 62. The master controller will thus know that the last temporary "identification" signal it received was from the actual last car in the train. It will also know exactly how many cars are in the train and will have the order of the cars in its database or list, as shown in block 76.

The master controller will display the number of cars in the train and the identification of the last car in the train for verification by the engineer, as also shown in blocks 74 and 76, who presumably is provided with a manifest containing the number of cars in the train and the last car in the train before, during, or after train setup. If the last car in the train identified is the actual last car in the train, as verified by the engineer and shown in diamond 80, the car identification and ordering process is complete, as shown in oval 82. If the last car in the train identified is not the actual last car in the train, the engineer must check the communications path beyond the car the master controller identified as the last car in the train, as shown in block 84. After checking the communications path after an error is detected, the engineer will begin a new ordering sequence, as shown in block 40. It should be appreciated that the master controller could be programmed to electronically compare the number of cars and the identification of the last car to imputed data on the number of cars and the last car in the train to verify this information.

Alternative hard-wired communication means between the cars and the locomotive may be employed in the car ordering system of the present invention. For instance, instead of twisted-pair cable, the hard-wired communication between the master controller and the car controllers may be overlaid on the power line of the train. This power line which obtains power from the locomotive is a heavy gauge cable that runs from the locomotive to the last car in the train and has conventional mating connectors between the cars to facilitate separation of the cars. This single line serves as the power source for charging the batteries for the car controllers. The electrical communications or messages are carried on this line from the master controller to the car controllers. For temporarily suspending signal messages from traveling to trailing or successive cars in the train, each car is equipped with a normally closed relay, controlled by the car controller and placed on or connected to the power line. To disable communications between cars, the controller on the front car energizes the relay causing the disconnection of the power line to the successive cars in the train. To enable communications to the trailing cars, the car controller de-energizes the relay causing the power line to reconnect. Accordingly, this embodiment of the car control system does not have a device which amplifies the signal. For purposes of the car ordering system of the present invention, the relay is considered a repeater which facilitates transfer of the signal from one car to another and which can be temporarily disabled. It should be appreciated that if the power line is temporarily disconnected, the car controller on the trailing cars will rely solely on their battery power until the power line is reconnected.

Figure 5:
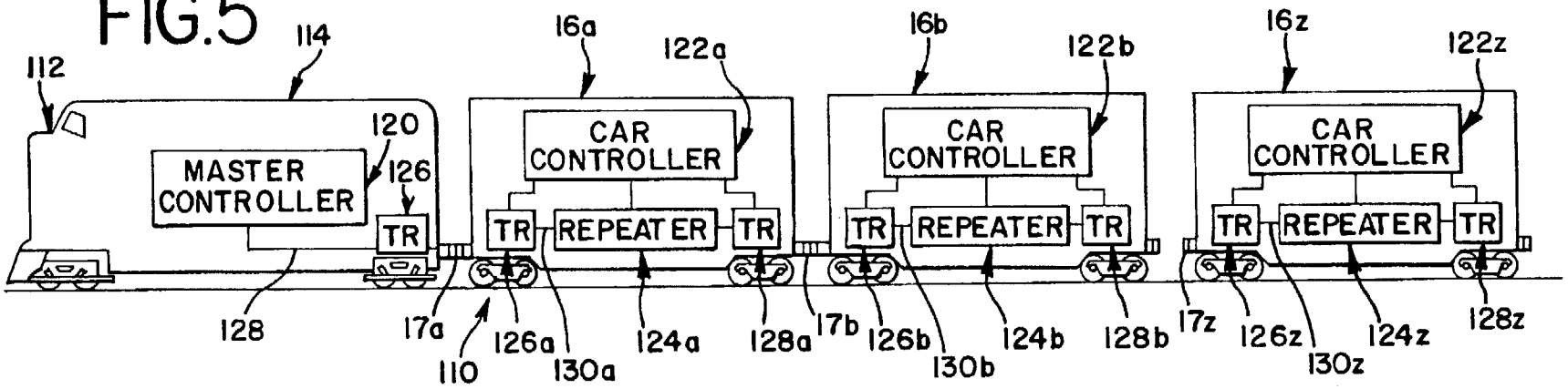
FIG. 5 is a fragmentary schematic view of a train equipped with an alternative embodiment of the car identification and ordering system of the present invention and illustrating the master controller on the locomotive, a car controller on each car, a repeater on each car, and a transceiver at each end of the car providing wireless communication.

Referring now to FIG. 5, a further alternative embodiment of car ordering system of the present invention, generally indicated by numeral 110, includes wireless communications in the train 112 between the locomotive 114 and the first car 116*a* and between adjacent cars 116*a*, 116*b*, . . . and 116*z*. The car ordering system 110 generally includes a master controller 120, a wireless transceiver 126 ("TR") on the locomotive connected to the master controller 120, car controllers 122*a*, 122*b*, . . . and 122*z*, repeaters 124*a*, 124*b*, . . . and 124*z* on each car, and a pair of wireless transceivers 126*a* and 128*a*, 126*b* and 128*b*, . . . and 126*z* and 128*z*, respectively, mounted on each end of the cars. The front transceivers 126*a*, 126*b*, . . . and 126*z* are suitably connected by wires or cables 130*a*, 130*b*, and 130*z* to the rear transceivers 128*a*, 128*b*, . . . and 128*z*. The car controllers 122*a*, 122*b*, . . . and 122*z* are respectively connected to the transceivers as well as monitoring the signals transmitted along wires 130*a*, 130*b*, . . . and 130*z*. The repeaters 124*a*, 124*b*, . . . and 124*z* can be signaled by the car controllers 122*a*, 122*b*, . . . and 122*z*, respectively, to temporarily suspend transmission of messages from the front transceivers 126*a*, 126*b*, . . .. and 126*z*, to the rear transceivers 128*a*, 128*b*, . . . and 128*z*, thereby disabling communication to cars trailing the car having the disabled repeater. The car ordering system 110 thus operates in the same manner as the car ordering system 10 and includes the same fail-safe systems. Alternatively, the car controller and the repeater may disable the transfer of messages to the trailing car by temporarily shutting down the transmitter portion of the transceivers 128*a*, 128*b*, . . . and 182*z*. The transceivers may be of the radio frequency transceiver type or of the infra-red transceiver type. It should also be appreciated that the car controller can determine the direction of the master controller (i.e., the locomotive) by alternatively monitoring each of the transceivers for signals from the master controller. Preferably, the transceivers would be spread spectrum radio frequency units.

It should be further appreciated that wireless communication between the cars and locomotive could be established by a single transceiver unit on each car which then would include a means operated by the controllers as a repeater that would enable and disable the transmitter of each unit. The repeater would be enabled first for communicating with the locomotive and secondly to allow communication with a trailing car.

It should be appreciated that each car could be configured with a two-position switch connected to the car controller and mounted in an accessible location during train setup. The switch has a "non-last car" position and a "last car" position. During train setup, the switch on the last car of the train can be manually placed in the "last car" position, while the switches on all of the other cars are maintained in a "non-last car" position. During the car ordering process, this "last car" information is sent to the master controller along with the "identification" signal from the last car as a verification that that car is the last car in the train. If two or more cars have switches in the "last car" position, the engineer will be notified by the master controller and at the engineer's option the last car actually identified by the car ordering system will be considered the last car regardless of switch positions. The master controller will also notify the engineer of the error condition and inform the engineer of the identification of the offending cars. The engineer can correct this problem by resetting the appropriate switches.

It will be understood that modifications and variations may be effected without departing from the scope of the novel concepts of the present invention, and it is understood that this application is to be limited only by the scope of the appended claims.

The invention is hereby claimed as follows:

1. A car identification and ordering system for a train having a locomotive and a plurality of cars attached to the locomotive, said system comprising:

master controller means on the locomotive for initiating and controlling the car identification and ordering system, car controller means on each car of the train for responding to commands from the master controller means, communication means on the locomotive and on each of said cars for establishing communication between the master controller means on the locomotive and said car controller means on each car in the train, said communication means including repeater means on each car for transferring signals to a directly trailing car in the train, said repeater means adapted to be selectively temporarily disabled to cut off communication to said trailing car and thereby all successive cars in the train, such that an identification request signal from the master controller is not communicated to the trailing car or any of said successive cars in said train means on the car controller means for selectively temporarily disabling the repeater means on each car to cut off communication to said trailing car and thereby all said successive cars in said train, and means on the car controller means for selectively reenabling the repeater means on each car to reestablish communication to said trailing car when said car sends an identification signal to said master controller, wherein said system is adapted to identify each car in the train, the physical order of said cars in the train, the number of cars in the train, and the identification of the last car in the train.

2. The car identification and ordering system of claim 1, wherein the communication means includes hard-wiring along the length of the train.

3. The car identification and ordering system of claim 2, wherein the hard-wiring includes a twisted-pair cable along the length of the train.

4. The car identification and ordering system of claim 2, wherein said train includes a power line therealong, and the hard-wiring is electrically overlaid on the power line.

5. The car identification and ordering system of claim 1, wherein the communication means includes wireless transceivers on the cars along the length of the train.

6. The car identification and ordering system of claim 5, wherein the wireless communication means includes radio frequency transceivers.

7. The car identification and ordering system of claim 5, wherein the wireless communicator means includes infrared transceivers.

8. The car identification and ordering system of claim 1, which further includes means for re-enabling said repeater means after a predetermined period of time following said repeater means being selectively disabled.

9. The car identification and ordering system of claim 1, which further includes manually operated switchable means for the car controller means on the last car in the train for indicating to said master controller that said car is the last car in the train.

10. A car identification and ordering system for a train having a locomotive and a plurality of cars attached to the locomotive, said system comprising:

means for establishing communication between the locomotive and each car in the train, a repeater on each car which enables the transfer of communication signals to a directly trailing car in the train, said repeater adapted to be selectively temporarily disabled to prevent transfer of the communication signals to said trailing car and thereby all successive cars in the train, a master controller on the locomotive connected to said communication means, said master controller including a microprocessor which controls the car ordering system, digitally stores information on the identity of each car in the train, the physical order of those cars, the total number of cars, and the identity of the last car in the train, and which sends and receives signals to and from said cars through the communication means, and a car controller on each car connected to said communication means, said car controller including a microprocessor which digitally stores information on the identity of said car and which sends signals to said locomotive through the communication means, said car controller having means for selectively temporarily disabling said repeater to prevent signals from being transferred to said trailing car and thereby all said successive cars in said train, such that an identification request signal from the master controller is not communicated to the trailing car or any of said successive cars in said train and means for selectively reenabling said repeater to reestablish communication to said trailing car when said car sends an identification signal to said master controller, such that an identification request signal from the master controller is communicated to the trailing car in said train, wherein said system is adapted to identify each car in the train, the physical order of said cars in the train, the number of cars in the train, and the identification of the last car in the train.

11. The car identification and ordering system of claim 10, wherein each said car controller includes means for re-enabling said repeater after a predetermined period of time.

12. The car identification and ordering system of claim 10, wherein the repeater on each car is adapted to allow the cars to be set up in the train in either direction.

13. The car identification and ordering system of claim 10, wherein the car controller on each car includes means for reenabling itself after a predetermined period of time.

14. The car identification and ordering system of claim 10, wherein the repeater on each car includes means for reenabling itself after a predetermined period of time.

15. The car identification and ordering system of claim 10, wherein the master controller includes means for terminating the ordering of the ordering mode after a predetermined period of time.

16. A process for identifying the number and physical order of cars in a train having a locomotive and a plurality of cars attached to the locomotive, a master controller on the locomotive, a car control device on each car, means for communicating and sending signals between said master controller and said car control devices including means on each car for transferring signals received from the master controller to a directly trailing car in the train, said process comprising the steps of a) sending an ordering mode signal from the master controller to the car control device on each of the cars in the train, one by one, via the communication means, b) temporarily disabling the transfer means on each car in the train to prevent each said car from transferring signals between said car and the directly trailing car and thereby all successive cars in said train, c) sending an identification request signal from the master controller to the car trailing the locomotive via the communication means and to all cars which directly trail a car with an enabled transfer means, d) sending an identification signal to the master controller from the car control device which receives the identification request signal and which has not previously sent an identification signal to the master controller, e) enabling said transfer means on said car which sends the identification signal to allow said car to thereafter transfer a signal to the directy trailing car thereof, and f) repeating steps (c) through (e) until no further identification signals are received by the master controller within a predetermined time period thereby completing the process.

17. A method for identifying the number and physical order of cars in a train having a locomotive and a plurality of cars attached to the locomotive, a master controller on the locomotive, a car control device on each car, means for communicating between said master controller and said car control devices including signal repeater means on each car operable in an enable mode to transmit signals received by the car control device to the directly trailing car and in a disabling mode to prevent transmission of such signals said method comprising the steps of a) sending an ordering mode signal from the master controller to the car control device on each of the cars one by one in the train via the communication means, b) temporarily disabling said signal repeater means on each car to prevent communication between each car and the car trailing said car in the train and thereby all successive cars, c) sending an identification request signal from the master controller to the car control device in the car next to the locomotive via the communication means and to all cars which directly trail a car with an enabled signal repeater means d) sending an identification signal to the master controller from the car control device which receives the identification request signal and which has not previously sent an identification signal to the master controller, e) enabling the signal repeater means on the car which sends the identification signal to enable communication with the directly trailing car in the train, and f) repeating steps (c) through (e) until no further identification signals are received by the master controller within a predetermined time period.

18. The method of claim 17, which further includes the step of digitally comparing the number of cars identified to imputed data on the number of cars.

19. The method of claim 17, which further includes the step of visually displaying the number of cars for verification by the engineer.

* * * * *

UNITED STATES PATENT AND TRADEMARK OFFICE

CERTIFICATE OF CORRECTION

PATENT NO. : 5,777,547

DATED : July 7, 1998

INVENTOR(S) : Jeremy S. Waldrop

It is certified that error appears in the above-indentified patent and that said Letters Patent is hereby corrected as shown below:

Col. 12, line 59, delete "visually".

Signed and Sealed this

Fifteenth Day of September, 1998

*Attest:*

*Attesting Officer*

Bruce Lehman

BRUCE LEHMAN

*Commissioner of Patents and Trademarks*